US010808343B2

(12) United States Patent
Wiles et al.

(10) Patent No.: US 10,808,343 B2
(45) Date of Patent: Oct. 20, 2020

(54) HIGH PERFORMANCE SPORT SLEEVE

(71) Applicants: Katelyn Michelle Wiles, Newport Beach, CA (US); Brandon Martin Goris, Newport Beach, CA (US)

(72) Inventors: Katelyn Michelle Wiles, Newport Beach, CA (US); Brandon Martin Goris, Newport Beach, CA (US)

( * ) Notice: Subject to any disclaimer, the term of this patent is extended or adjusted under 35 U.S.C. 154(b) by 0 days.

(21) Appl. No.: 15/348,840

(22) Filed: Nov. 10, 2016

(65) Prior Publication Data

US 2017/0127735 A1 May 11, 2017

Related U.S. Application Data

(60) Provisional application No. 62/253,709, filed on Nov. 11, 2015.

(51) Int. Cl.

| | |
|---|---|
| ***A41D 13/00*** | (2006.01) |
| ***D05B 23/00*** | (2006.01) |
| ***A41D 13/06*** | (2006.01) |
| *A63B 71/12* | (2006.01) |

(52) U.S. Cl.

CPC ..... *D05B 23/006* (2013.01); *A41D 13/065* (2013.01); *A41D 2400/80* (2013.01); *A41D 2600/10* (2013.01); *A63B 2071/125* (2013.01); *A63B 2209/00* (2013.01); *A63B 2244/09* (2013.01)

(58) Field of Classification Search

CPC . A41D 1/02; A41D 1/06; A41D 15/00; A41D 15/002; A41D 15/02; A41D 17/02; A41D 13/065

USPC ..... 2/69, 269, 22, 242; 602/63

See application file for complete search history.

(56) References Cited

U.S. PATENT DOCUMENTS

| | | | | | |
|---|---|---|---|---|---|
| 2,125,451 | A * | 8/1938 | Kolliner | A41D 17/00 | 2/242 |
| 3,892,239 | A * | 7/1975 | Masso Remiro | A61F 13/06 | 604/312 |
| 4,272,850 | A * | 6/1981 | Rule | A41D 13/065 | 2/24 |
| 4,632,106 | A * | 12/1986 | Gamm | A61F 13/101 | 602/63 |
| 4,905,320 | A * | 3/1990 | Squyers, Jr. | A41D 13/015 | 2/2.5 |
| 5,010,597 | A * | 4/1991 | Glover | A41D 17/02 | 2/22 |
| 5,735,807 | A * | 4/1998 | Cropper | A61F 5/0109 | 602/26 |
| 5,896,676 | A * | 4/1999 | Barousse | A41D 17/02 | 36/2 R |
| 6,129,695 | A * | 10/2000 | Peters | A41D 13/05 | 602/61 |
| 6,520,926 | B2 * | 2/2003 | Hall | A61F 5/01 | 602/64 |
| 7,025,738 | B2 * | 4/2006 | Hall | A61F 5/01 | 602/75 |
| 7,908,674 | B2 * | 3/2011 | Jones | A41B 11/125 | 2/242 |
| 9,301,553 | B1 * | 4/2016 | Donovan | A41D 1/00 | |
| 2011/0185467 | A1 * | 8/2011 | Suarez | A41D 13/05 | 2/22 |

(Continued)

*Primary Examiner* — Timothy K Trieu

(74) *Attorney, Agent, or Firm* — Charney IP Law LLC; Thomas M. Finetti

(57) ABSTRACT

Sport sleeves comprising one or more anti-slip components are disclosed.

10 Claims, 3 Drawing Sheets

(56) References Cited

U.S. PATENT DOCUMENTS

2011/0245748 A1* 10/2011 Rinke ..... A61F 13/00063
602/43
2015/0273310 A1* 10/2015 Johnston ..... A41D 1/08
2/16

* cited by examiner

HIGH PERFORMANCE SPORT SLEEVE

CROSS-REFERENCE TO RELATED APPLICATIONS

The present application claims the benefit of the filing date of U.S. Provisional Patent Application 62/253,709, filed Nov. 11, 2015, the disclosure of which is hereby incorporated by reference herein in its entirety.

BACKGROUND OF THE DISCLOSURE

Participants in many sporting activities are often looking to increase their performance in their sport. Sporting activities that involve participants to lift weights using barbells, weights, or weight machines, such as weightlifting, powerlifting, bodybuilding allow participants to increase their performance during exercise, or competition. To assist the participant with increasing their performance a variety of high performance equipment has been developed. Such equipment may include elastic wrist wraps, elastic knee sleeves, leather belts, and knee sleeves. Often, such equipment is specifically designed for use in particular sporting activity, such as knee sleeves for powerlifting to assist in exercises such as the squat.

SUMMARY OF THE DISCLOSURE

In one aspect of the present disclosure is a sport device comprising a sleeve configured to wrap around a knee of a user; the sport device having an upper portion configured to wrap around at least a portion of the user's leg above the user's knee and a lower portion configured to wrap around at least a portion of the user's leg below the user's knee. In some embodiments, the sleeve comprises at least one antimicrobial component embedded within the sleeve or coated onto a surface of the sleeve, wherein the antimicrobial component is selected from the group consisting of silver, copper, and combinations thereof. In some embodiments, the sleeve has a funnel shape. In some embodiments, the sleeve is composed of neoprene. In some embodiments, the sleeve is constructed from a single piece of material. In some embodiments, the sleeve comprises one or more anti-slip components. In some embodiments, the anti-slip components are arranged on an inner surface of the sleeve such that the anti-slip components contact a user's leg. In some embodiments, a first anti-slip component is arranged on the inner surface of the sleeve at a first opening; and a second anti-slip component is arranged on the inner surface of the sleeve at a second opening. In some embodiments, the anti-slip components are arranged as continuous or discontinuous bands that circumscribe the inner surface at the first and second openings. In some embodiments, the anti-slip components comprise a material selected from the group consisting of silicones, rubbers, and combinations thereof.

In another aspect of the present disclosure is a method of manufacturing a sport device configured to wrap around a knee of a user, the sport device having an upper portion configured to wrap around at least a portion of the user's leg above the user's knee and a lower portion configured to wrap around at least a portion of the user's leg below the user's knee, comprising the steps of (i) gluing a neoprene piece together at their edges to form a glued seam; and (ii) creating a blind stitch along the glued seam. In some embodiments, the blind stitch is created by puncturing the neoprene material on a single side without penetrating the opposite side of the material.

DETAILED DESCRIPTION

In general, the present disclosure is directed to a sleeve 100 configured to be placed over an appendage of a human subject. In some embodiments, the sleeve comprises a hollow, tubular member having a first opening 110 and a second opening 120, the sleeve configured to be positioned over or around a knee of a human subject. In some embodiments, the sleeve is configured to anatomically conform to the appendage, e.g. a knee.

Figure 1:
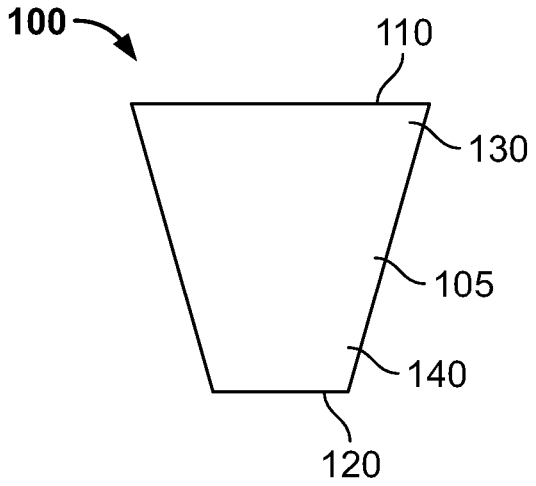
FIG. 1 is a side view of a sport sleeve of an embodiment of a sleeve according to the present disclosure.

Referring to FIG. 1, in some embodiments, the total length of the sleeve ranges from about 20 cm to about 36 cm. In some embodiments, the sleeve comprises an upper portion 130 and a lower portion 140. In some embodiments, the upper portion 130 wraps around a user's leg above the user's knee. In some embodiments, the upper portion 130 covers or wraps around a user's leg from the knee to about 5 cm to about 13 cm above the knee. In other embodiments, the upper 130 portion covers or wraps around a user's leg from the knee to about 5 cm to about 10 cm above the knee. In yet other embodiments, the upper portion 130 covers or wraps around a user's leg from the knee to about 7.5 cm to about 10 cm above the knee. In some embodiments, the lower portion 140 wraps around a user's leg below the user's knee. In other embodiments, the lower portion 140 covers or wraps around a user's leg from the knee to about 5 cm to about 13 cm below the knee. In yet embodiments, the lower portion 140 covers or wraps around a user's leg from the knee to about 5 cm to about 10 cm below the knee. In further embodiments, the lower portion 140 covers or wraps around a user's leg from the knee to about 7.5 cm to about 10 cm below the knee.

In some embodiments, the upper portion 130 tapers from a first cross-sectional dimension to a second cross-sectional dimension. In some embodiments, the first cross-sectional dimension ranges from about 15 cm to about 22 cm. In some embodiments, the first cross-sectional dimension is located at the first opening 110. In some embodiments, the second cross-sectional dimension ranges from about 13 cm to about 20 cm. In some embodiments, the second cross-sectional dimension is positioned at about the center of the sleeve. In some embodiments, the lower portion 140 tapers from a second cross-sectional dimension to a third cross-sectional dimension. In some embodiments, the third cross-sectional dimension ranges from about 11.5 cm to about 17 cm. In some embodiments, the third cross-sectional dimension is located at the second opening 120.

In some embodiment, the sleeve 100 is comprised of a material selected from the group consisting of a resilient elastomeric foam sheath, neoprene, spandex, knitted nylon tricot fabric, lycra, and other knitted, woven or non-woven fabrics such as cotton, rayon, stretchable synthetic fibers, etc. In some embodiments, the sleeve comprises a covering over an outer surface 105. In some embodiments, the covering is an abrasive resistant fabric covering. In some embodiments, the elastomeric foam is adapted to contact the body. The skilled artisan will appreciate that the elastomeric foam sheath comprised may have any thickness, e.g. a thickness ranging from between 3 mm to about 7 mm.

Figure 2:
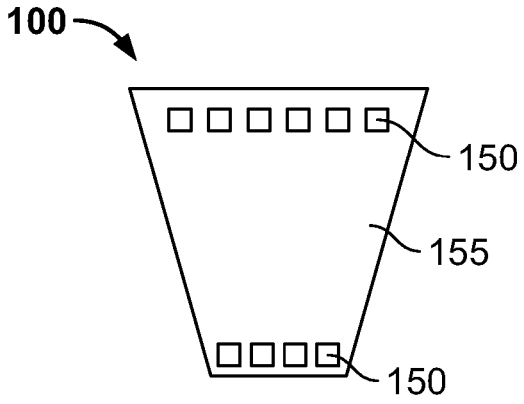
FIG. 2 is a side view of an interior surface of an embodiment of a sleeve according to the present disclosure.
Figure 3:
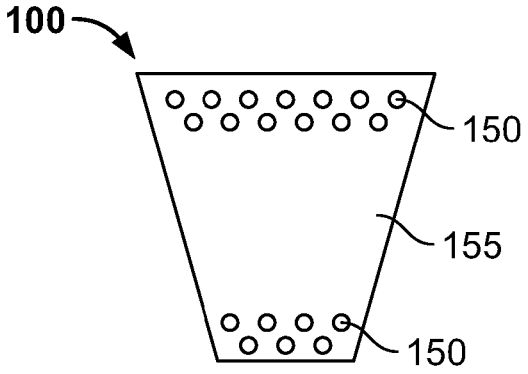
FIG. 3 is a side view of an interior surface of an embodiment of a sleeve according to the present disclosure.
Figure 4:
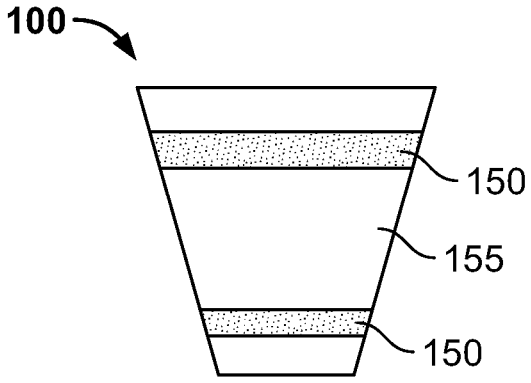
FIG. 4 is a side view of an interior surface of an embodiment of a sleeve according to the present disclosure.
Figure 5:
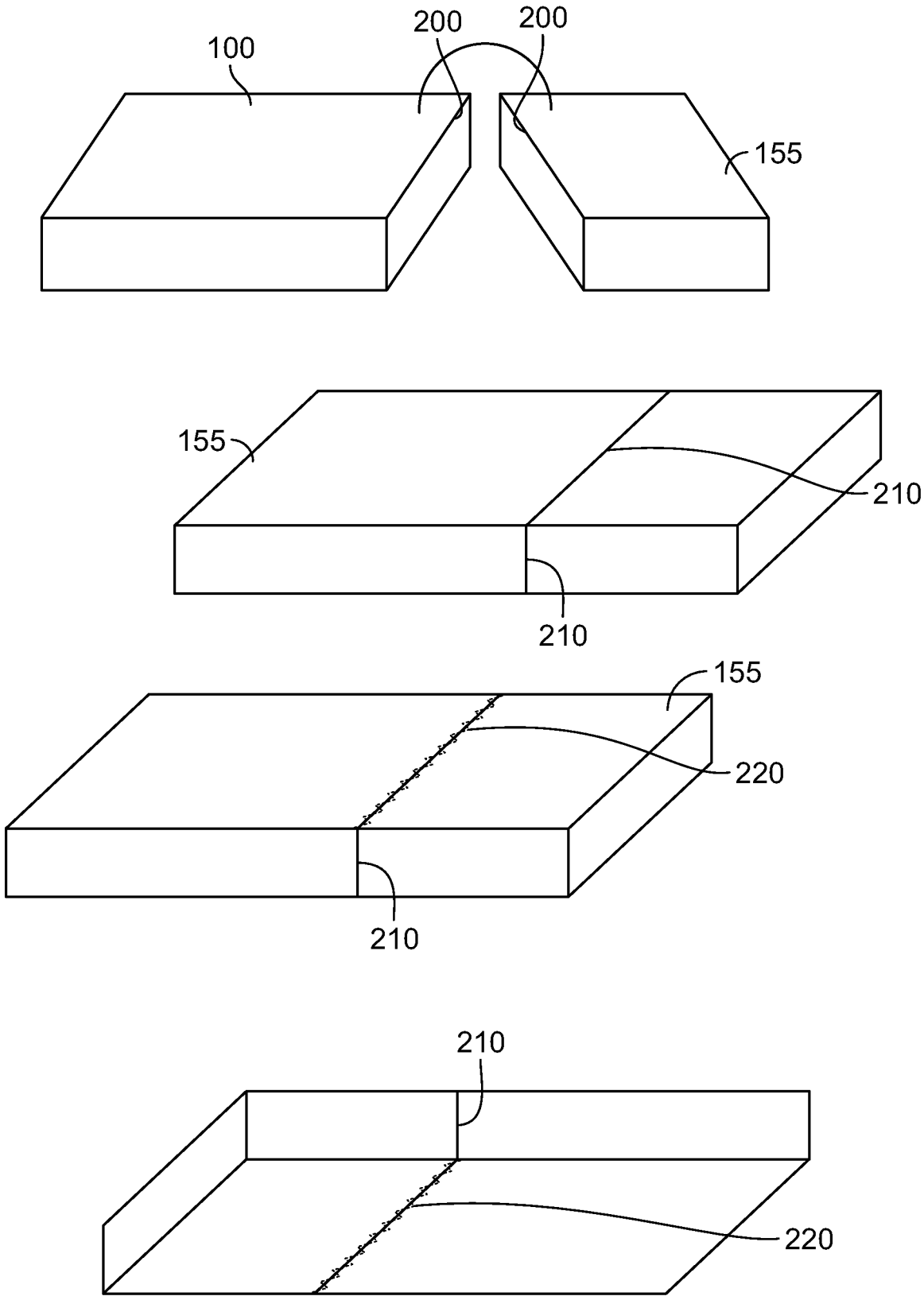
FIG. 5 illustrates a process of forming a sleeve of the present disclosure.
Figure 6:
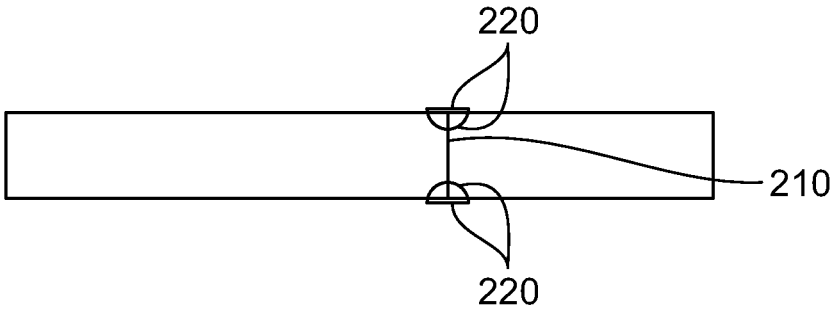
FIG. 6 illustrates a side view of the seam of the sport sleeve of the present disclosure.

Referring to FIGS. 2 through 4, in some embodiments, the sleeve 100 comprises one or more anti-slip components 150. In some embodiments, the anti-slip components are designed to prevent or mitigate the sleeve from slipping either up or down along the length of the appendage. In some embodiments, the anti-slip components are provided on an inner surface 155 of the sleeve, i.e. an interior surface of the tubular member facing the user's leg, and designed to contact the skin of the user. The skilled artisan will appreciate that the anti-slip components may have any size and shape. For example, the anti-slip components may be in the form of polygonal or circular dots. In some embodiments, the anti-slip components have a height ranging from between about 5 mm to about 8 mm and a width ranging from about 20 mm to about 24 mm.

With reference to FIG. 2, in some embodiments, a series of anti-slip components 150 form a discontinuous band proximal to one or both the first 110 and second 120 openings of the sleeve 100. In these embodiments, the individual anti-slip components 150 are typically spaced between 1 mm and 10 mm from each other to form the discontinuous band.

With reference to FIG. 4, in some embodiments, the anti-slip components are a single continuous bands of anti-slip materials, which may again be positioned proximal to one or both the first 110 and second 120 openings of the sleeve 100. In some embodiments, the anti-slip components may substantially circumscribe the inner surface 155 of the sleeve.

With reference to FIG. 3, in some embodiments, multiple rows of anti-slip components 150 may be positioned on the inner surface 155 of the sleeve. In some embodiments, the multiple rows of anti-slip components may run parallel to each other. In some embodiments, the multiple rows of anti-slip components 150 may be positioned proximal to either of the first and second openings 110 and 120, respectively.

In some embodiments, the anti-slip components are comprised a material selected from the group consisting of silicone, rubbers, or any other material having properties which result in friction between the anti-slip components and a user's skin. In some embodiments, the material is selected from a rubber that is the reaction product of from about 5% to about 10% VI/ST dimethyl-methylvinylsiloxane, about 60% to about 80% vinylpolydimethylsiloxane, about 10% to about 30% D4 and HMDZ treated silicon dioxide reacted with about 60% to about 80% vinylpolydimethylsiloxane, about 5% to about 10% VI/ST dimethylvinylsiloxane, about 1% to about 5% polymethylhydrogensiloxane and about 10% to about 30% D4 and HMDZ treated silicon dioxide In some embodiments, the sleeve 100 is formed from a single piece of material. In some embodiments, the edges 200 of a single piece of material that are appropriately sized and shaped are brought together (e.g. to form the tubular shape). The edges are placed end-to-end and glued together to form a glued seam 210. Without wishing to be bound by any particular theory, it is believed that gluing of the portions of the sleeve together increases the strength of the resulting seam and contributes to providing a waterproof seal. The edges, after they are glued together, are then stitched together using a blind stitch 220. "Blind stitch" sewing comprises the operation of sewing a turned up part with an internal part of the item on which it is folded, here the material comprising the sleeve. The sewing passes through the entire thickness of the turned up part of the material of the sleeve but does not pass through the entire thickness of the material of the sleeve on which the turn-up lays down. In this way, the sewing does not emerge outside and therefore is not visible from the external part of the sleeve itself. It is believed that this process minimizes puncture holes that can cause the material to tear more easily, and provides flexibility and strength. In some embodiments, this process is then repeated on the other side of the material creating a double blind stitch.

In some embodiments, the sleeve comprises an antimicrobial component either embedded within the material comprising the sleeve, or coated onto at least an inner surface of the sleeve, i.e. the side that is contact with the user's leg. In some embodiments, the antimicrobial material is selected from the group consisting of silver, copper and any combination thereof.

The invention claimed is:

1. A sleeve comprising a single piece of material having a single layer, wherein the sleeve is configured to wrap around a knee of a user when it is worn by the user; the sleeve having an upper portion configured to wrap around and circumscribe the user's leg above the user's knee and a lower portion configured to wrap around at least a portion of the user's leg below the user's knee, wherein the sleeve comprises a funnel shape whereby a first opening having a first cross-sectional dimension tapers towards a second opening having a second cross-sectional dimension, wherein the first cross-section dimension is greater than the second cross-sectional dimension, and wherein the sleeve is composed of neoprene, wherein the sleeve comprises one or more anti-slip components which are arranged on an inner surface of the sleeve such that the anti-slip components directly contact a user's leg when it is work by the user, and wherein the sleeve comprises a single blind stitch.

2. The sleeve of claim 1, wherein a first anti-slip component of the one or more anti-slip components is arranged on the inner surface of the sleeve at the first opening; and a second anti-slip component of the one or more anti-slip components is arranged on the inner surface of the sleeve at the second opening.

3. The sleeve of claim 1, wherein the one or more anti-slip components are arranged as continuous or discontinuous bands that circumscribe the inner surface at the first and second openings.

4. The sleeve of claim 3, wherein the one or more anti-slip components are arranged as continuous bands.

5. The sleeve of claim 1, wherein the one or more anti-slip components arranged on the inner surface of the sleeve comprise a material selected from the group consisting of silicones, rubbers, and combinations thereof.

6. A sleeve comprising a single piece of material having a single layer, wherein the sleeve is configured to wrap around a knee of a user; the sleeve having an upper portion configured to wrap around and circumscribe the user's leg above the user's knee and a lower portion configured to wrap around at least a portion of the user's leg below the user's knee, wherein the sleeve comprises a funnel shape whereby a first opening having a first cross-sectional dimension tapers towards a second opening having a second cross-sectional dimension, wherein the sleeve comprises one or more anti-slip components which are arranged on an inner surface of the sleeve such that the anti-slip components contact a user's leg when it is worn by the user, wherein the one or more anti-slip components arranged on the inner surface of the sleeve comprise a material selected from the group consisting of silicones, rubbers, and combinations thereof, and wherein the sleeve comprises a single seam.

7. The sleeve of claim 6, wherein the one or more anti-slip components are arranged as continuous or discontinuous bands that circumscribe the inner surface at the first and second openings.

8. The sleeve of claim 7, wherein the one or more anti-slip components are arranged as continuous bands.

9. A sleeve comprising a single, contiguous piece material having a single layer and wherein the single piece of material having the single layer is covered with an abrasive resistant fabric coating, wherein the sleeve is configured to wrap around a knee of a user; the sleeve having an upper portion configured to wrap around and circumscribe the user's leg above the user's knee and a lower portion configured to wrap around at least a portion of the user's leg below the user's knee, wherein the sleeve comprises a funnel shape whereby a first opening having a first cross-sectional dimension tapers towards a second opening having a second cross-sectional dimension, wherein the first cross-section dimension is greater than the second cross-sectional dimension, and wherein the sleeve is composed of neoprene, wherein the sleeve comprises one or more anti-slip components which are arranged on an inner surface of the sleeve such that the anti-slip components directly contact a user's leg when it is worn by the user, and wherein the sleeve comprises a single blind stitch.

10. The sleeve of claim 9, wherein the sleeve comprising an abrasive resistant fabric coating.

* * * * *